US010792790B2

(12) United States Patent
Li

(10) Patent No.: US 10,792,790 B2
(45) Date of Patent: Oct. 6, 2020

(54) MISALIGNED LOCKING AND RELEASING RATCHET MECHANISM AND RATCHET CLAMP

(71) Applicants: Hangzhou Great Star Industrial Co., Ltd., Hangzhou (CN); Hangzhou Great Star Tools Co., Ltd., Hangzhou (CN)

(72) Inventor: Yueming Li, Zhejiang Province (CN)

(73) Assignees: Hangzhou Great Star Industrial Co., Ltd., Hangzhou (CN); Hangzhou Great Star Tools Co., Ltd., Hangzhou (CN)

( * ) Notice: Subject to any disclaimer, the term of this patent is extended or adjusted under 35 U.S.C. 154(b) by 0 days.

(21) Appl. No.: 15/546,807

(22) PCT Filed: Jan. 4, 2017

(86) PCT No.: PCT/CN2017/070165
§ 371 (c)(1),
(2) Date: Jul. 27, 2017

(87) PCT Pub. No.: WO2018/126360
PCT Pub. Date: Jul. 12, 2018

(65) Prior Publication Data

US 2019/0314957 A1 Oct. 17, 2019

(51) Int. Cl.
*B25B 5/06* (2006.01)
*B25B 5/16* (2006.01)
(Continued)

(52) U.S. Cl.
CPC ..... *B25B 5/06* (2013.01); *B25B 5/16* (2013.01); *B25B 7/123* (2013.01); *B25B 7/14* (2013.01)

(58) Field of Classification Search
CPC .. B25B 5/06; B25B 5/16; B25B 7/123; B25B 7/14; B25B 7/18
(Continued)

(56) References Cited

U.S. PATENT DOCUMENTS 6,227,081 B1 * 5/2001 Bally ..... B25B 7/12 81/355
6,708,587 B1 3/2004 Noniewicz et al.
(Continued)

FOREIGN PATENT DOCUMENTS

CN 1923464 A 3/2007
CN 203390768 U 1/2014
(Continued)

*Primary Examiner* — David B. Thomas
*Assistant Examiner* — Thomas Raymond Rodgers
(74) *Attorney, Agent, or Firm* — Dinsmore & Shohl LLP

(57) ABSTRACT

The present invention discloses a ratchet clamp comprising a first clamping arm and a second clamping arm which are pivotally connected with each other via a connecting shaft so as to be opened and closed relative to each other, a ratchet assembly, a swing assembly and a control assembly provided between the first clamping arm and the second clamping arm; the ratchet toothed assembly has a plurality of first ratchet teeth and a plurality of second ratchet teeth which are juxtaposed and are misaligned with each other; the swing assembly and the ratchet toothed assembly are moved away from or towards each other with the connecting shaft as the axial center of rotation; a latch member of the control assembly has at least a first pawl and at least a second pawl, a wrench member of the control assembly is used for toggling the latch member to be moved, the first pawls and the second pawls are respectively engaged with the corresponding first ratchet teeth and second ratchet teeth when the latch member is moved to an engaged position, and the first pawls and the second pawls are respectively moved away from the corresponding first ratchet teeth and the second
(Continued)

ratchet teeth when the latch member is moved to a released position. With the misaligned ratchet tooth design, the tooth profile may not be reduced, thereby increasing the structural strength, so that the overall clamping force is greatly enhanced.

21 Claims, 12 Drawing Sheets

(51) Int. Cl.
*B25B 7/12* (2006.01)
*B25B 7/14* (2006.01)

(58) Field of Classification Search
USPC ..... 81/330, 338
See application file for complete search history.

(56) References Cited

U.S. PATENT DOCUMENTS

| | | | | |
|---|---|---|---|---|
| 2004/0031131 | A1* | 2/2004 | Ping | B25B 5/06 24/499 |
| 2006/0208407 | A1* | 9/2006 | Wang | B25B 5/06 269/6 |
| 2007/0052145 | A1 | 3/2007 | Cantin | |

FOREIGN PATENT DOCUMENTS

| | | | |
|---|---|---|---|
| CN | 105328595 | A | 2/2016 |
| CN | 105397655 | A | 3/2016 |
| CN | 105983921 | A | 10/2016 |
| JP | H11277454 | A | 10/1999 |

* cited by examiner

MISALIGNED LOCKING AND RELEASING RATCHET MECHANISM AND RATCHET CLAMP

CROSS-REFERENCE TO RELATED APPLICATION

This application is the U.S. national stage of PCT/CN2017/070165 filed Jan. 4, 2017, the entire content of which is incorporated herein by reference.

FIELD OF THE INVENTION

The present invention relates to the field of hand tools, and in particular to a misaligned locking and releasing ratchet mechanism and a ratchet clamp.

BACKGROUND OF THE INVENTION

Hand tools refer to small tools that are gripped by hand to act on an object with a human force or with other force controlled by a human being, which are used for manually cutting and aiding in decorating, and are generally provided with handles for easy portability. The pliers are a class of commonly used hand tools for clamping and fastening a machined workpiece or twisting, bending, and cutting a metal wire. The pliers for clamping and fastening the machined workpiece are also known as clamping pliers or clamps.

The clamping pliers or clamps are generally V-shaped, which are usually formed by two pieces of clamping bodies which are symmetrical with each other in structure and configuration and are partially overlapped and fastened by riveting. The clamps can be opened and closed flexibly with their riveting connection point as a supporting point, and the design of which contains lever principle, thereby a small external force (such as a force applied to the clamping arms) can be converted into a larger clamping force at the jaws, so that the clamps can clamp effectively.

Since no mechanism for locking the position of the clamping arms is provided on the artificial clamps in the prior art, the human hand must keep a relatively large force on the clamps until the clamping task is completed when an object is clamped. This is both laborious and time-consuming, and the clamping is not reliable. In this regard, the US patent "Vise-Grip or Expanding Pliers" (Patent Number: U.S. Pat. No. 6,708,587B1) provides a technical solution that the position of the clamping arms is locked by means of ratchet tooth, that the components with ratchet tooth are respectively provided on both of the clamping arms, one of the components is not movable relative to the clamping arm to which it is connected, so that one component is rotatable relative to the clamping arm to which it is connected, the ratchet tooth on both components are inter-engaged, and the two sets of inter-engaged ratchet tooth are provided to allow the two clamping arms to move towards each other and impede the two clamping arms to move away from each other; and an actuation component is provided on the outside of one clamping arm (which is remote from one side of the other clamping arm), specifically an automatic reset key: the actuation component is connected, via a locking component, to a component having ratchet tooth which is rotatable relative to the clamping arm to which it is connected, to control whether or not the component having ratchet tooth is engaged with another component having ratchet tooth.

In the use of the clamps, when a user applies a pair of facing forces to the two clamping arms (i.e., the direction of the force received by one clamping arm is directed to the other clamping arm), the locking component holds the two sets of ratchet tooth to be inter-engaged, the two sets of ratchet tooth can move relative to each other, thereby allowing the two clamping arms to move towards each other, then the two portions of the jaw move towards each other to clamp the object to be clamped; when the object is clamped, the user removes the facing forces applied on the two clamping arms, the locking component holds the two sets of ratchet tooth to be inter-engaged, the two sets of ratchet tooth cannot move relative to each other, thereby the jaw keeps a clamping state; when the user presses the actuation component and applies a pair of opposing forces to the two clamping arms (i.e., the direction of the force received by one clamping arm is directed away from the other clamping arm), the locking component is opened, the clamping force is at least partially released, the two sets of ratchet tooth are no longer inter-engaged, thereby allowing the two clamping arms to move in opposite directions to each other, then the two portions of the jaw move in opposite directions to each other to release the clamped object.

However, since the actuation component of the prior art clamps is provided on the outside of one of the clamping arms thereof, the user needs to press the actuation component when releasing the clamped object, and it can be known that the user, when pressing the actuation component, needs to apply a force directed to the other clamping arm to the clamping arm where the actuation component is located, and the direction of the force is opposite to the direction of the force applied to the hand gripping the clamping arm during two actuations thereof, therefore, such an operation is awkward and more laborious.

Therefore, those skilled in the art are committed to developing a self-locking ratchet clamp to allow the user to operate smoothly and effortlessly.

SUMMARY OF THE INVENTION

In view of the above-mentioned drawbacks of the prior art, the technical problem to be solved by the present invention is the situation that the existing ratchet clamps are awkward and laborious for the user to release.

To achieve the above object, the present invention provides a misaligned locking and releasing ratchet mechanism, including:

a ratchet toothed assembly including one or more racks each having a plurality of ratchet teeth, the ratchet teeth on the different racks are juxtaposed and are misaligned with each other; and a control member having a latch portion and a trigger portion, the latch portion has one or more pawls each having one or more ratchet teeth, the ratchet teeth on different pawls are juxtaposed and are misaligned with each other; the trigger portion is used for toggling the control member, so that the pawls of the latch portion and the racks of the ratchet toothed assembly are moved between an engaged position and a released position;

one or more of the ratchet teeth on only one of the racks are engaged with the corresponding one or more ratchet teeth and the other racks are not engaged with the corresponding ratchet teeth of the pawls when the latch portion is moved to the engaged position, and all the racks and the pawls are simultaneously released when the latch portion is moved to the released position.

Further, the control member is an assembly, including a latch member and a wrench member, the wrench member has a protrusion and the latch member has an indentation, the protrusion is used for being embedded into the indentation; the protrusion toggles the latch member within the indentation to be rotationally displaced when the wrench member is rotationally displaced.

The present invention also provides a ratchet clamp, including a first clamping arm, a second clamping arm and a ratchet mechanism, the first clamping arm and the second clamping arm are pivotally connected to each other via a connecting shaft so as to be opened or closed, the ratchet mechanism is provided between the first clamping arm and the second clamping arm, the ratchet mechanism includes: a ratchet toothed assembly provided on the first clamping arm, the ratchet toothed assembly has a plurality of first ratchet teeth and a plurality of second ratchet teeth, the plurality of first ratchet teeth and the plurality of second ratchet teeth are juxtaposed and are misaligned with each other; a swing assembly provided on the second clamping arm, the first clamping arm and the second clamping arm respectively drive the swing assembly and the ratchet toothed assembly to move away from or towards each other with the connecting shaft as the axial center of rotation; and a control assembly having at least one latch member and at least one wrench member, the latch member is pivotally connected to the swing assembly, the latch member has at least one first pawl and at least one second pawl, the wrench member is pivotally connected to the swing assembly, the wrench member is used for toggling the latch member to be moved between the engaged position and the released position, the first pawls and the second pawls are respectively engaged with the corresponding plurality of first ratchet teeth and the plurality of second ratchet teeth when the latch member is moved to the engaged position, and the first pawls and the second pawls are respectively moved away from the corresponding plurality of first ratchet teeth and the plurality of second ratchet teeth when the latch member is displaced to the released position.

Further, the connecting shaft is sleeved with a torsion spring, the two ends of the torsion spring abut against the first clamping arm and the second clamping arm, respectively, the first clamping arm and the second clamping arm are normally held in an open position by means of elastic force of the torsion spring, the swing assembly is pivotally connected to the second clamping arm via a first shaft through which the swing assembly is braked to move along with the second clamping arm, the ratchet toothed assembly is pivotally connected to the first clamping arm via a second shaft and a third shaft through which the ratchet toothed assembly is braked to move along with the first clamping arm.

Further, the swing assembly includes: a guide groove formed on one side of the swing assembly for the ratchet toothed assembly to slide therein, the ratchet toothed assembly is arcuate strip-shaped, the shape of the guide groove matches the shape of the ratchet toothed assembly, so that the ratchet toothed assembly slides in the guide groove in an arcuate path; a receiving groove formed on the other side of the swing assembly for the control member to be pivotally provided therein, and an opening provided between the guide groove and the receiving groove for the guide groove and the receiving groove to communicate with each other, the plurality of first ratchet teeth and the plurality of second ratchet teeth extend through the opening into the receiving groove when the ratchet toothed assembly is placed into the guide groove, so that the plurality of first ratchet teeth correspond to the first pawls and the plurality of second ratchet teeth correspond to the second pawls.

Further, the ratchet toothed assembly includes: a first rack on which the plurality of first ratchet teeth are provided; and a second rack which is in parallel with the first rack and on which the plurality of second ratchet teeth are provided, the first rack and the second rack are both arcuate strip-shaped, the arc center points of the first rack and the second rack coincide with the circle center of the connecting shaft.

Further, the plurality of first ratchet teeth each have a first ratchet tooth tip end and a first ratchet tooth groove end, and the plurality of second ratchet teeth each have a second ratchet tooth tip end and a second ratchet tooth groove end, each of the first ratchet tooth tip ends and each of the second ratchet tooth groove ends are in parallel with each other, and each of the first ratchet tooth groove ends and each of the second ratchet tooth tip ends are in parallel with each other.

Further, the control assembly includes: a first wrench member; a second wrench member, the first wrench member and the second wrench member are pivotally connected to the swing assembly via a fourth shaft, respectively, and the first wrench member and the second wrench member are respectively driven to be rotationally displaced with the fourth shaft as the center of rotation; a first latch member on which the first pawls are provided; and a second latch member on which the second pawls are provided, the first latch member and the second latch member are pivotally connected to the swing assembly via a fifth shaft, respectively, and the first latch member and the second latch member are respectively driven to be rotationally displaced with the fifth shaft as the center of rotation.

Further, the first wrench member has a first protrusion for being embedded into a first indentation of the first latch member, the second wrench member has a second protrusion for being embedded into a second indentation of the second latch member, the first protrusion toggles the first latch member within the first indentation to be rotationally displaced and the second protrusion toggles the second latch member within the second indentation to be rotationally displaced when the first wrench member and the second wrench member are rotationally displaced.

Further, the first latch member further includes the plurality of first pawls, the second latch member further includes the plurality of second pawls, the first latch member and the second latch member are provided in parallel with each other, so that the plurality of first pawls and the plurality of second pawls are misaligned with each other, the plurality of first pawls each have a first pawl tip end and a first pawl groove end, and the plurality of second pawls each have a second pawl tip end and a second pawl groove end, each of the first pawl tip ends and each of the second pawl groove ends are in parallel with each other, and each of the first pawl groove ends and each of the second pawl tip ends are in parallel with each other.

Further, the ratchet toothed assembly has a first rack, the plurality of first ratchet teeth and the plurality of second ratchet teeth are juxtaposed on the first rack, respectively, and the first rack is arcuate strip-shaped, and the arc center point of the first rack coincides with the circle center of the connecting shaft.

Further, the plurality of first ratchet teeth each have a first ratchet tooth tip end and a first ratchet tooth groove end, and the plurality of second ratchet teeth each have a second ratchet tooth tip end and a second ratchet tooth groove end, each of the first ratchet tooth tip ends and each of the second ratchet tooth groove ends are in parallel with each other, and each of the first ratchet tooth groove ends and each of the second ratchet tooth tip ends are in parallel with each other.

Further, the control assembly includes: a first wrench member which is pivotally connected to the swing assembly via a fourth shaft, the first wrench member and the second wrench member are respectively driven to be rotationally displaced with the fourth shaft as the center of rotation; and a first latch member on which the first pawls and the second pawls are provided, respectively, the first latch member is pivotally connected to the swing assembly via a fifth shaft, and the first latch member is respectively driven to be rotationally displaced with the fifth shaft as the center of rotation, the first wrench member has a first protrusion for being embedded into a first indentation of the first latch member, the first protrusion toggles the first latch member within the first indentation to be rotationally displaced when the first wrench member is rotationally displaced.

Further, the first latch member further includes the plurality of first pawls and the plurality of second pawls, the plurality of first pawls and the plurality of second pawls are misaligned with each other, and the plurality of first pawls each have a first pawl tip end and a first pawl groove end, and the plurality of second pawls each have a second pawl tip end and a second pawl groove end, each of the first pawl tip ends and each of the second pawl groove ends are in parallel with each other, and each of the first pawl groove ends and each of the second pawl tip ends are in parallel with each other.

Further, the control assembly includes: a first wrench member; a trigger member which is juxtaposed at the side of the first wrench member and is smaller than the first wrench member, the first wrench member and the trigger member are pivotally connected to the swing assembly via a fourth shaft, respectively, and the first wrench member and the trigger member are respectively driven to be rotationally displaced with the fourth shaft as the center of rotation; a first latch member on which the first pawls are provided; and a second latch member on which the second pawls are provided, the first latch member and the second latch member are pivotally connected to the swing assembly via a fifth shaft, respectively, and the first latch member and the second latch member are respectively driven to be rotationally displaced with the fifth shaft as the center of rotation.

Further, the first wrench member has a first protrusion for being embedded into a first indentation of the first latch member, the trigger has a trigger protrusion for being embedded into a second indentation of the second latch member, the first protrusion toggles the first latch member within the first indentation to be rotationally displaced and the trigger protrusion toggles the second latch member within the second indentation to be rotationally displaced, when the first wrench member and the trigger member are rotationally displaced.

Further, the first latch member further includes the plurality of first pawls, the second latch member further includes the plurality of second pawls, the first latch member and the second latch member are provided in parallel with each other, so that the plurality of first pawls and the plurality of second pawls are misaligned with each other, the plurality of first pawls each have a first pawl tip end and a first pawl groove end, and the plurality of second pawls each have a second pawl tip end and a second pawl groove end, each of the first pawl tip ends and each of the second pawl groove ends are in parallel with each other, and each of the first pawl groove ends and each of the second pawl tip ends are in parallel with each other.

The ratchet clamp according to the present invention, with the design of two rows of ratchet teeth which are juxtaposed and misaligned with each other, allows the double rows of ratchet teeth to maintain the original structural strength without reducing the tooth profile, and increases the number of the ratchet teeth with the design of the double rows of misaligned ratchet teeth, thereby reducing the tooth spaces when engaged, to increase the overall engagement area, for dispersing the force applied on the ratchet teeth. It is ensured that the ratchet teeth and the pawls are able to tooth skip normally when they reach the default value of the clamping force so as to control the degree of clamping force applied by the accurate clamp mechanism to avoid the problems such as failing to skip smoothly, deviating easily, or breaking tooth due to abrasion when the clamping force reaches the default value.

The technical conception and the preferred embodiments of the present invention will be described in further detail below in conjunction with the accompanying drawings.

DETAILED DESCRIPTION OF THE INVENTION

Figure 1:
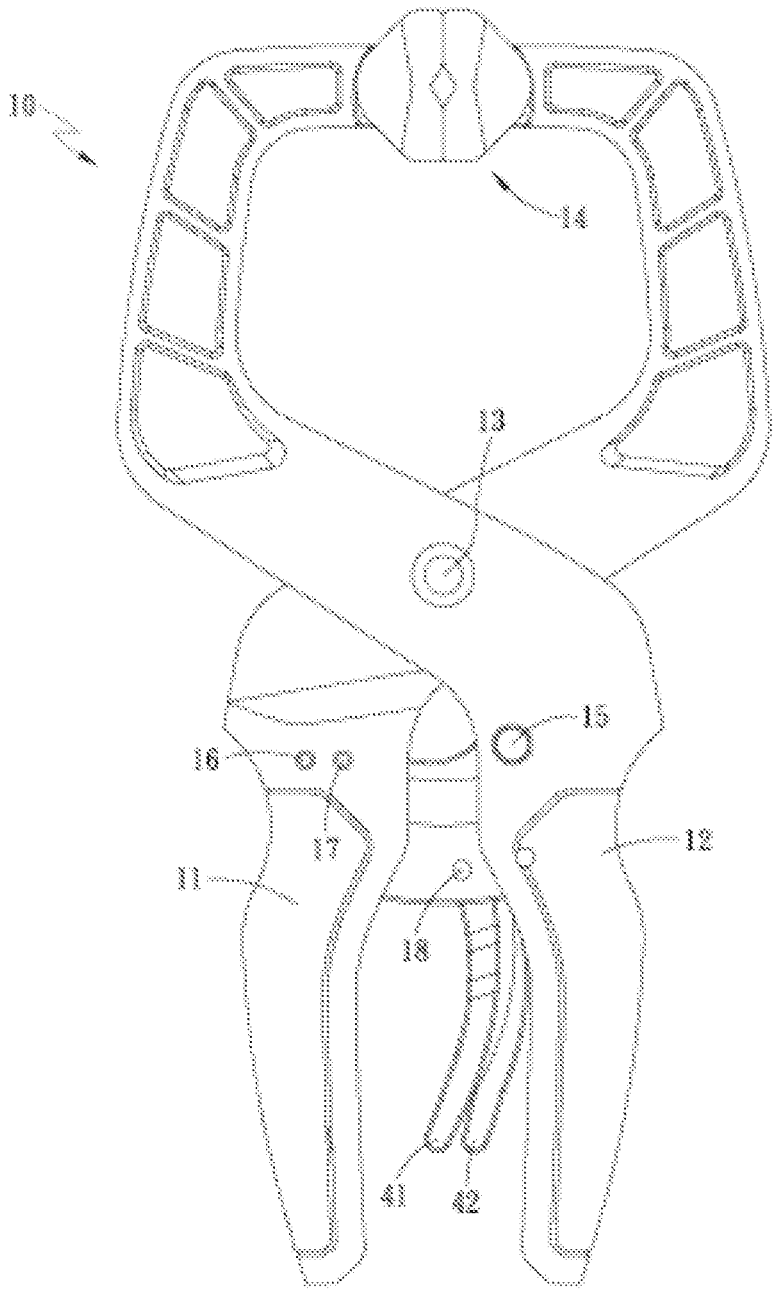
FIG. 1 is a front view of a ratchet clamp in accordance with the first embodiment of the present invention.
Figure 2:
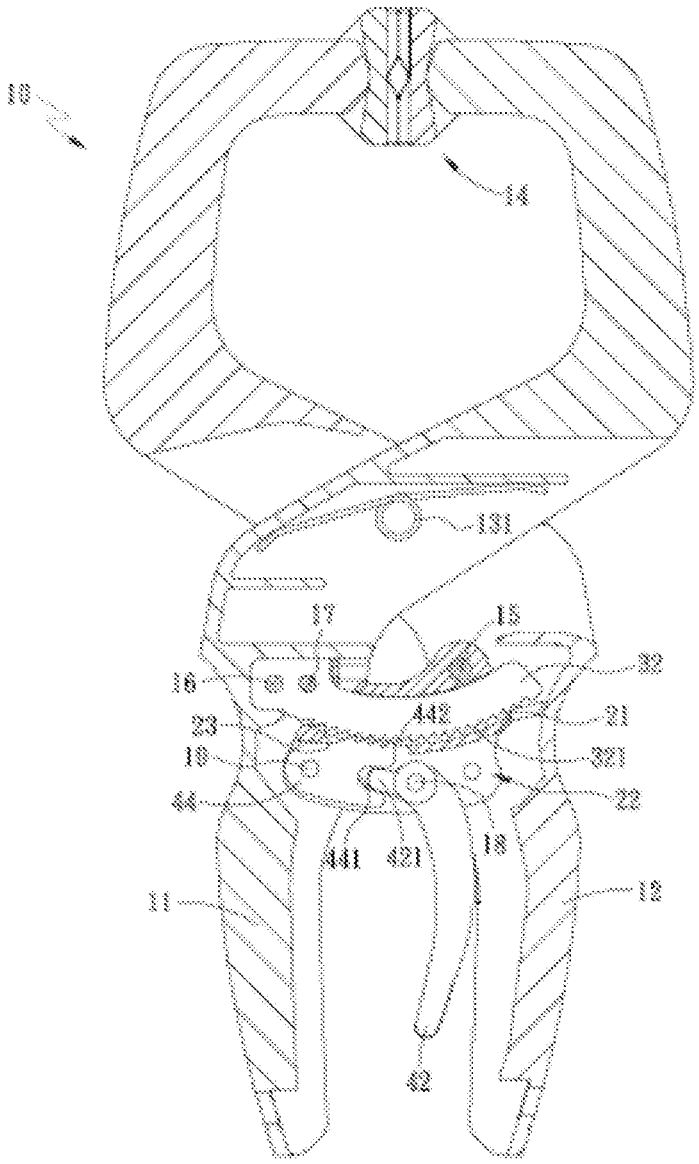
FIG. 2 is a cross-sectional view of a ratchet clamp in accordance with the first embodiment of the present invention.

FIGS. 1 and 2 show that configuration of the first embodiment of the ratchet clamp according to the present invention includes a clamping mechanism and a ratchet mechanism. The clamping mechanism 10 is formed of a first clamping arm 11 and a second clamping arm 12 connected to each other via a connecting shaft 13, and the connecting shaft is sleeved with a torsion spring 131, the two ends of the torsion spring 131 abut against the first clamping arm 11 and the second clamping arm 12, respectively, and the first clamping arm 11 and the second clamping arm 12 control opening or closing of a jaw 14 with the connecting shaft 13 as the center of rotation. Specifically, when the first clamping arm 11 and the second clamping arm 12 are operated to be moved towards each other, the jaw 14 can be gradually reduced and the torsion spring 131 is subjected to a force to be elastically deformed and the position of the jaw 14 is then fixed by the ratchet mechanism, so that the first clamping arm 11 and the second clamping arm 12 produce a desired clamping force, thereby clamping an article such as a workpiece. When the first clamping arm 11 and the second clamping arm 12 are operated to be moved away from each other, the ratchet mechanism needs to be firstly disengaged, and the jaw 14 is gradually enlarged by means of elastic reset force of the torsion spring 131, in this way the clamped workpiece is released.

Figure 3:
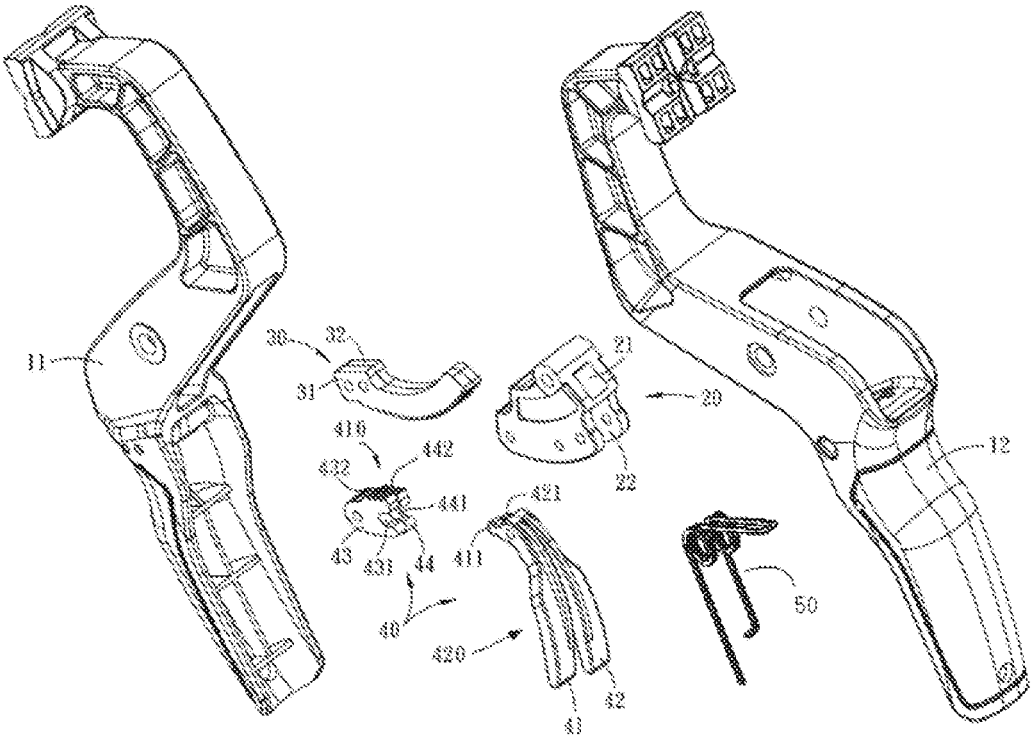
FIG. 3 is an exploded view of a ratchet clamp in accordance with the first embodiment of the present invention.

As shown in FIG. 3, the ratchet mechanism includes a swing assembly 20, a ratchet toothed assembly 30, and a control assembly 40. The swing assembly 20 is pivotally connected to the second clamping arm 12 via a first shaft 15, and the swing assembly 20 can be braked through the first shaft 15 to be displaced along with the second clamping arm 12 when the second clamping arm 12 reciprocally moves relative to the first clamping arm 11.

The swing assembly 20 has a guide groove 21, a receiving groove 22, and an opening 23. The guide groove 21 is formed on one side of the swing assembly 20 for the ratchet toothed assembly 30 to slide therein. The receiving groove 22 is formed on the other side of the swing assembly 20 for the control assembly 40 to be pivotally provided therein. In addition, the opening 23 is provided between the guide groove 21 and the receiving groove 22 for the guide groove 21 and the receiving groove 22 to communicate with each other.

Figure 4:
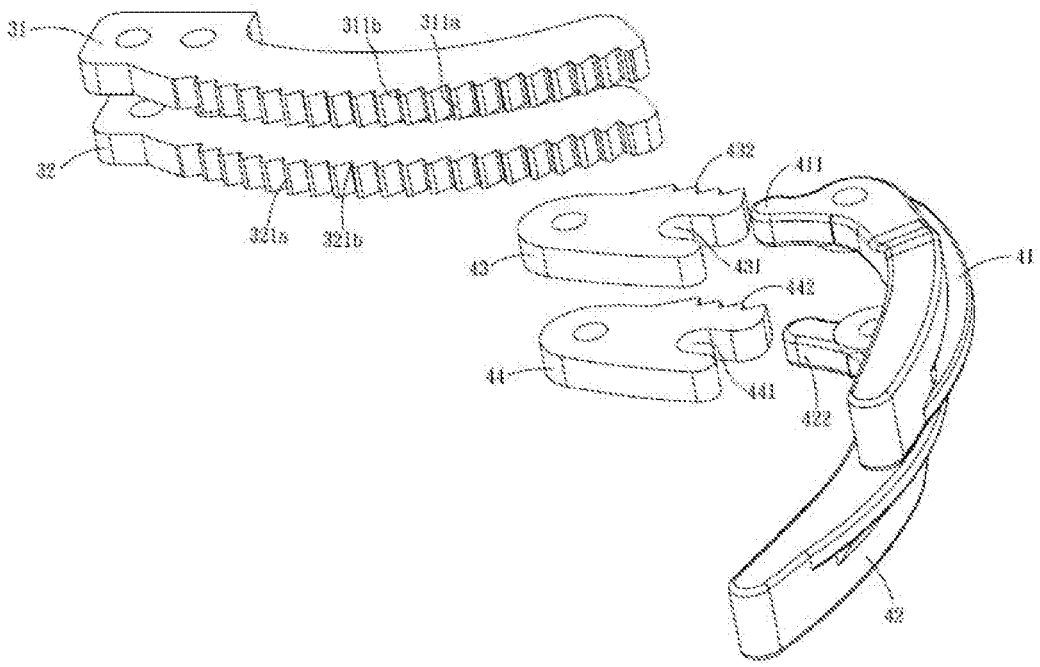
FIG. 4 is an exploded view of a ratchet toothed assembly and a control assembly in accordance with the first embodiment of the present invention.
Figure 5:
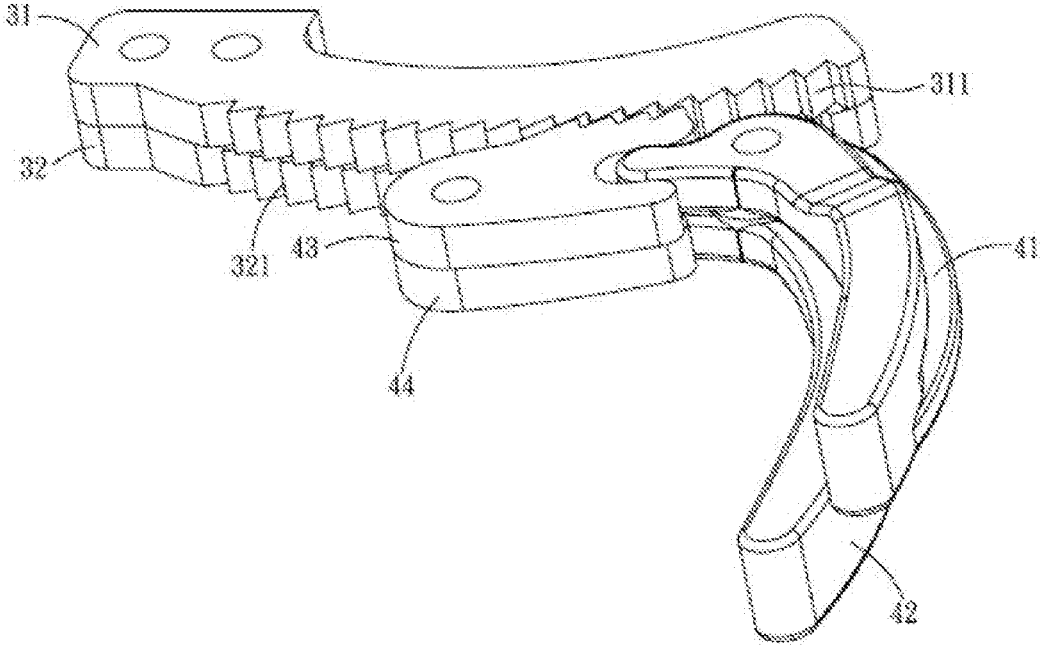
FIG. 5 is an engagement schematic view of a ratchet toothed assembly and a control assembly in accordance with the first embodiment of the present invention.

As shown in FIGS. 4 and 5, the ratchet toothed assembly 30 has a first rack 31 and a second rack 32 which are in parallel with each other, and the first rack 31 and the second rack 32 are both arcuate strip-shaped, the arc center points of the two racks 31, 32 coincide with the circle center of the connecting shaft 13, and the guide groove 21 of the swing assembly 20 also matches the shape of the two arcuate strip-shaped racks 31, 32, so that the guide groove 21 is also arc-shaped. In this way, both the first rack 31 and the second rack 32 can both slide therein along the guide groove 21.

The outer arc surface of the first rack 31 has a plurality of first ratchet teeth 311 and the second rack 32 also has a plurality of second ratchet teeth 321 on the outer arc surface thereof. Each of the first ratchet teeth 311 and each of the second ratchet teeth 321 are misaligned with each other when the first rack 31 and the second rack 32 are in parallel with each other. Specifically, the plurality of first ratchet teeth 311 each have a first ratchet tooth tip end 311*a* and a first ratchet tooth groove end 311*b*, and the plurality of second ratchet teeth 321 also each have a second ratchet tooth tip end 321*a* and a second ratchet tooth groove end 321*b*, and the first ratchet tooth tip ends 311*a* are juxtaposed with the second ratchet tooth groove ends 321*b* and the first ratchet tooth groove ends 311*b* are juxtaposed with the second ratchet tooth tip ends 321*a*, with the staggered structure design, the ratchet teeth 311, 321 of the juxtaposed two racks 31, 32 can be misaligned with each other.

The ratchet tooth 311, 321 of the two racks 31, 32 are exposed in the receiving groove 22 through the opening 23 when the first rack 31 and the second rack 32 of the ratchet toothed assembly 30 are placed into the guide groove 21 together. When the first rack 31 and the second rack 32 are pivotally connected to the first clamping arm 11 via a second shaft 16 and a third shaft 17, respectively, the ratchet toothed assembly 30 can be braked through the second shaft 16 and the third shaft 17 to be displaced along with the first clamping arm 11 and reciprocally slide in the guide groove 21 of the swing assembly 20, so that the ratchet tooth 311, 321 of the two racks 31, 32 can be reciprocally moved together in the receiving groove 22, respectively.

The control assembly 40 comprises a latch portion 410 and a trigger portion 420. The trigger portion 420 comprises [[has]] a first wrench member 41, a second wrench member 42, and the latch portion 410 comprises a first latch member 43, and a second latch member 44. The first wrench member 41 and the second wrench member 42 are respectively located in the receiving groove 22 of the swing assembly 20, and the first wrench member 41 and the second wrench member 42 are pivotally connected to the swing assembly 20 via a fourth shaft 18, respectively, and the first wrench member 41 and the second wrench member 42 are respectively driven to be wrenchingly displaced with the fourth shaft 18 as the center of rotation. In addition, a first protrusion 411 is provided at the front end of the first wrench member 41, and a second protrusion 421 is also provided at the front end of the second wrench member 42.

The first latch member 43 and the second latch member 44 are respectively located in the receiving groove 22 of the swing assembly 20, and the first latch member 43 and the second latch member 44 are pivotally connected to the swing assembly 20 via a fifth shaft 19, respectively, and the first latch member 43 and the second latch member 44 are respectively driven to rotate with the fifth shaft 19 as the center of rotation. The first latch member 43 has a first indentation 431 and a plurality of first pawls 432, the first indentation 431 is used for the first protrusion 411 of the first wrench member 41 to be embedded therein, and each of the first pawls 432 can be correspondingly engaged into each of the first ratchet teeth 311 of the first rack 31, respectively.

The second latch member 44 also has a second indentation 441 and a plurality of second pawls 442, and the second indentation 441 is used for the second protrusion 421 of the second wrench member 42 to be embedded therein, and each of the second pawls 442 can be correspondingly engaged into each of the second ratchet teeth 321 of the second rack 32, respectively.

It is to be noted that, each of the first pawls 432 and each of the second pawls 442 are misaligned with each other when the first latch member 43 and the second latch member 44 are in parallel with each other. Specifically, the plurality of first pawls 432 each have a first pawl tip end 432*a* and a first pawl groove end 432*b*, and the plurality of second pawls 442 also each have a second pawl tip end 442*a* and a second pawl groove end 442*b*, and the first pawl tip ends 432*a* are juxtaposed with the second pawl groove ends 442*b*, and the first pawl groove ends 432*b* are juxtaposed with the second pawl tip ends 442*a*, with the staggered structure design, the plurality of pawls 432, 442 of the two juxtaposed latch members 43, 44 can be misaligned with each other.

Figure 6:
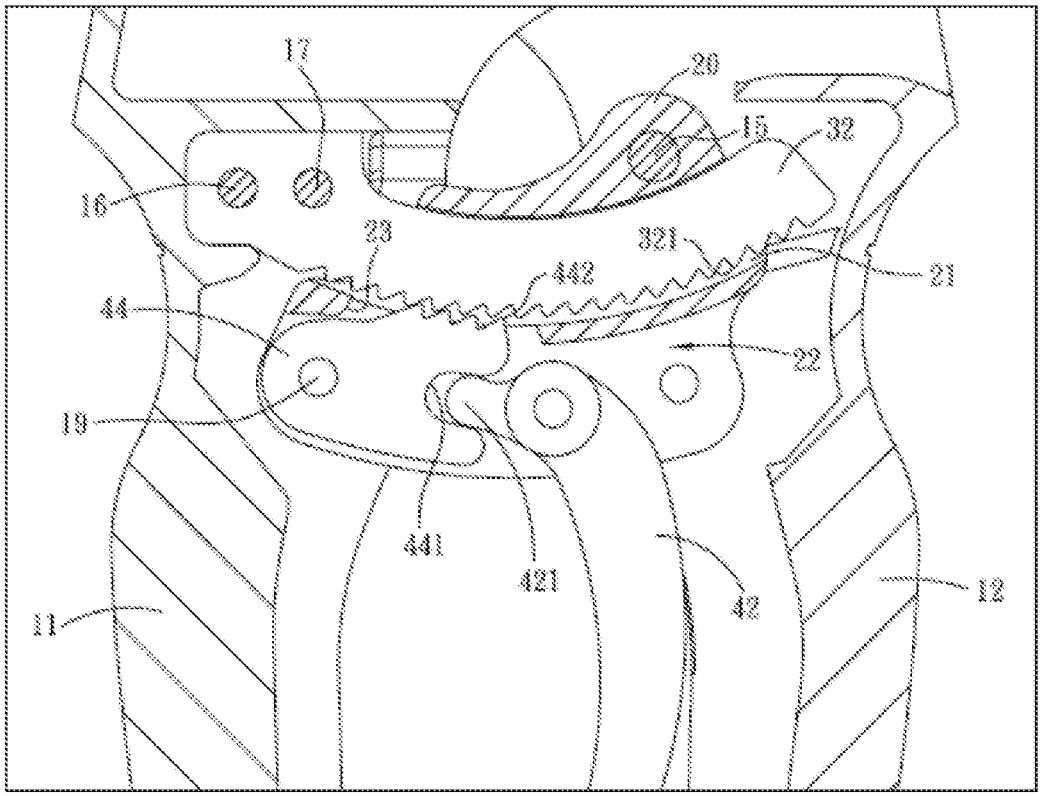
FIGS. 6 and 7 are action schematic views of a ratchet clamp in accordance with the first embodiment of the present invention.
Figure 7:
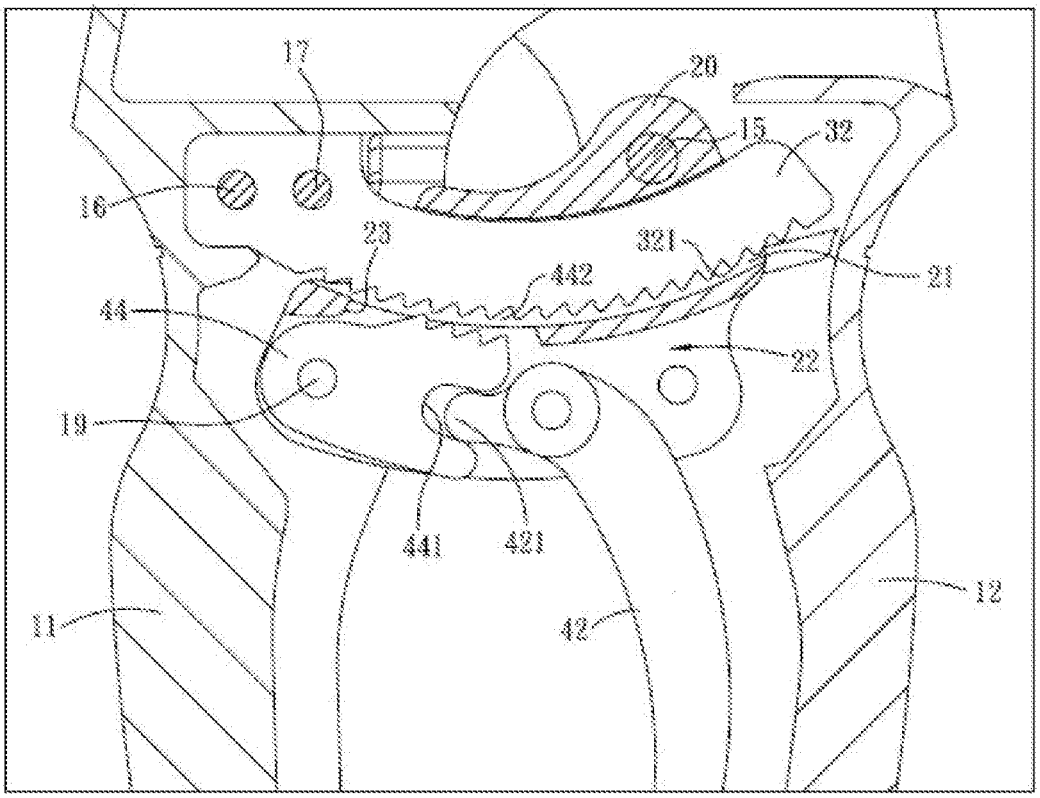

As shown in FIGS. 6 and 7, when a user operates the first clamping arm 11 and the second clamping arm 12 to move towards each other and clamps the clamped article, the torsion spring 131 is subjected to press by the two clamping arms 11, 12 to be elastically deformed, and the first pawls 432 of the first latch member 43 can be gradually skipped and be tightly engaged onto the corresponding first ratchet teeth 311 of the first rack 31, similarly, the second pawls 442 of the second latch member 44 are also gradually skipped and are tightly engaged onto the corresponding second ratchet teeth 321 of the second rack 32. Meanwhile, by means of elastic force provided by the elastic component 50, the first protrusion 411 of the first wrench member 41 is in the first indentation 431, the first latch member 43 is toggled to be normally held in the engaged position. And the second protrusion 421 of the second wrench member 42 is also in the second indentation 441, the second latch member 44 is toggled to be normally held in the engaged position. The clamping force of the two clamping arms 11, 12 can be maintained by the tight engagement between the two racks 31, 32 of the two latch members 43, 44.

Figure 14:
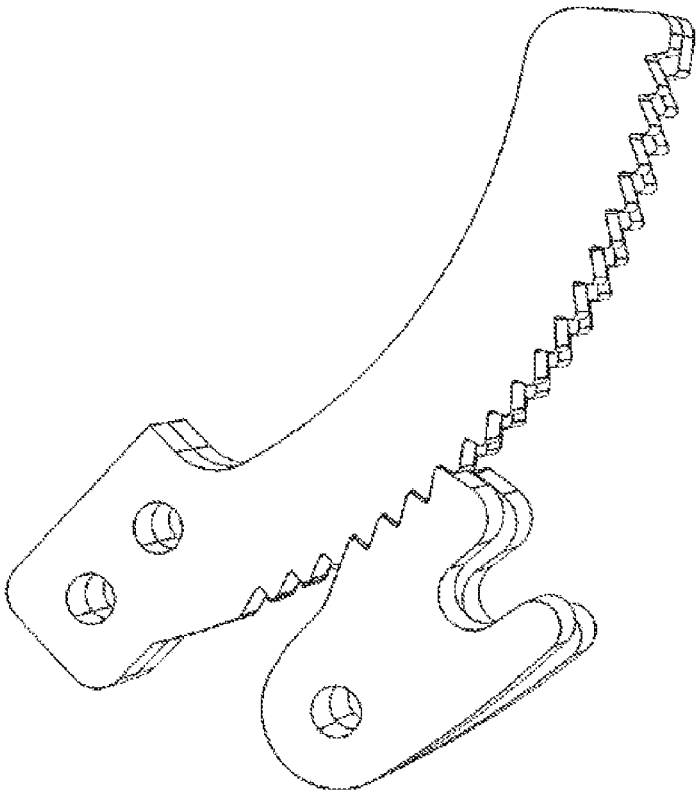
FIG. 14 is a schematic view of the engaged side of a misaligned locking mechanism of the present invention.
Figure 15:
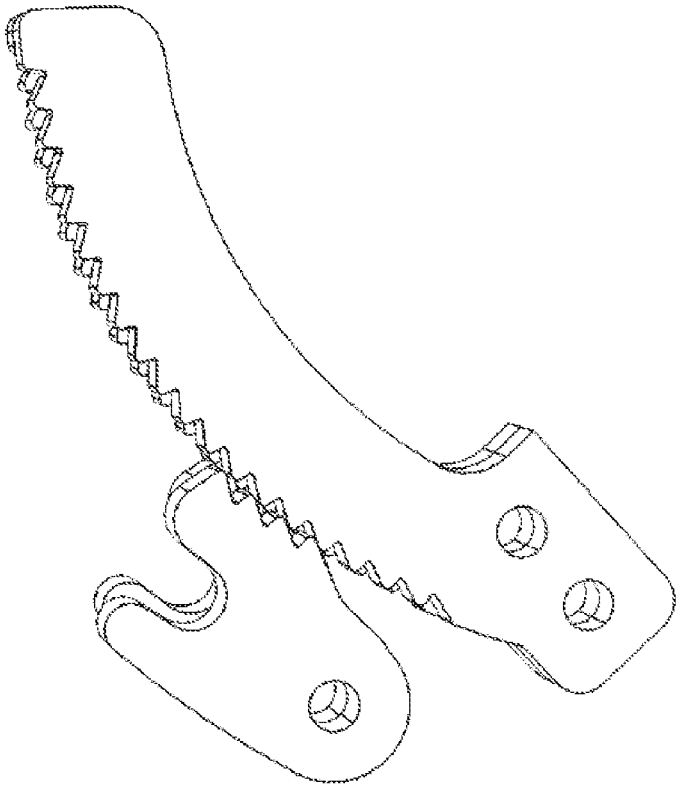
FIG. 15 is a schematic view of the released side of a misaligned locking mechanism of the present invention.

In order to make the ratchet mechanism more stable and reliable, the first ratchet teeth 311 and the second ratchet teeth 321 are designed to be misaligned with each other, and complementing with the engagement of misaligned first pawls 432 and second pawls 442. As shown in FIGS. 14 and 15, only one pair of ratchet tooth and pawl is engaged when engaged, and the other pair is not engaged. Under the premise of the same jaw process, with the misaligned ratchet tooth design, the tooth profile may not be reduced to increase the structural strength. And with the design of the double rows of misaligned ratchet tooth, the number of teeth can be additionally increased in order to reduce the skipping angle, thereby reducing the tooth spaces and increasing the structural strength, so that the overall clamping force is greatly enhanced.

In addition, with the misaligned ratchet tooth design, the pawls 432, 442 of the two latch members 43, 44 can be reliably engaged onto the ratchet teeth 311, 321 of the two racks 31, 32, respectively, to ensure that the ratchet teeth 311, 321 and the pawls 432, 442 are able to skip normally when they reach the default value of the clamping force so as to control the degree of clamping force applied by the accurate clamping mechanism 10 to avoid the problems such as failing to skip smoothly, deviating easily, or breaking tooth due to abrasion when the clamping force reaches the default value.

When a user operates the first clamping arm 11 and the second clamping arm 12 to move away from each other and release the clamped article, the first wrench member 41 can be first operated to be rotationally displaced so that the first protrusion 411 of the first wrench member 41 is in the first indentation 431, the first latch member 43 is toggled from the engaged position to the released position so that each of the first pawls 432 of the first latch member 43 is moved away from the corresponding first ratchet tooth 311. Similarly, the second wrench member 42 is then operated to be rotationally displaced so that the second protrusion 421 of the second wrench member 42 is in the second indentation 441, the second latch member 44 is toggled from the engaged position to the released position so that each of the second pawls 442 of the second latch member 44 is moved away from the corresponding second ratchet tooth 321, but not limited to the above-described operation sequence, the user can also first operate the second wrench member 42 and then operate the first wrench member 41 to disengage so as to gradually release the clamping force, and can also synchronously operate the first wrench member 41 and the second wrench member 42 to disengage to release the clamping force all at once, and the above-mentioned operation sequences are not intended to limit the scope of the claims. After the two latch members 41, 42 are respectively moved to the released position, the two clamping arms 11, 12 are returned to the open position by means of elastic reset force of the torsion spring 131, and then performs the next clamping operation.

Figure 8:
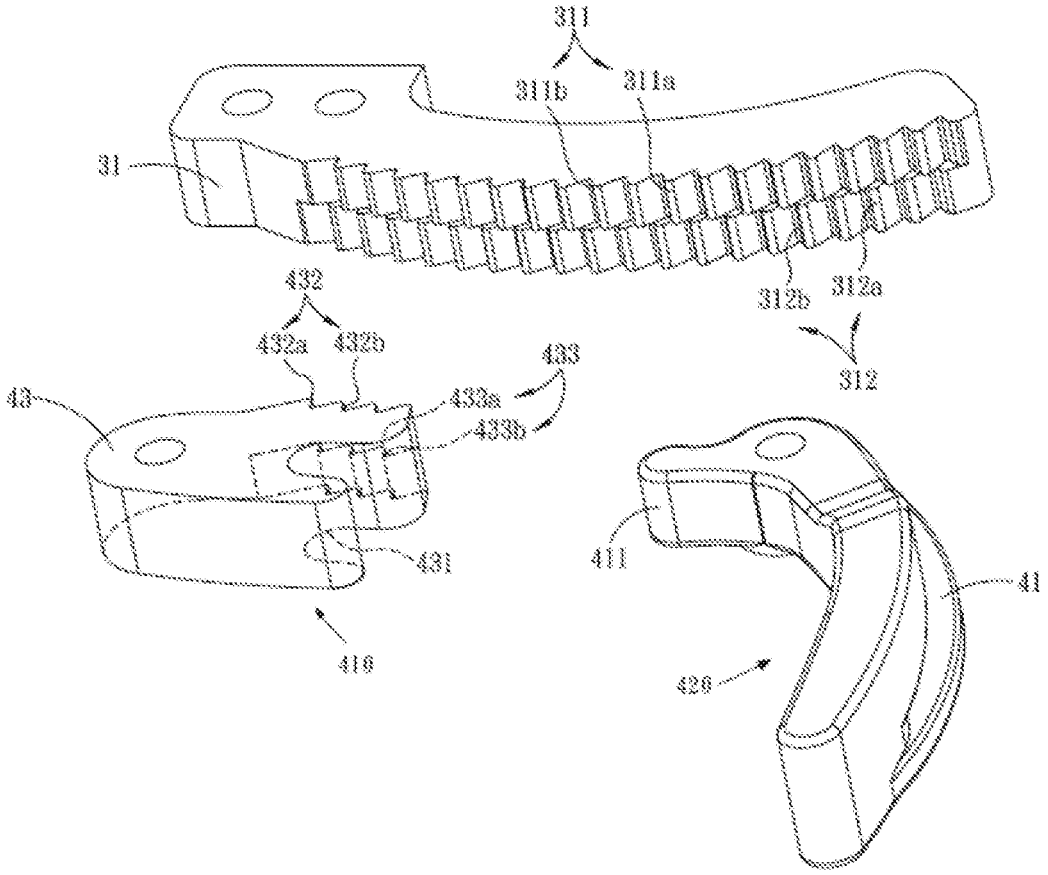
FIG. 8 is an exploded view of a ratchet toothed assembly and a control assembly in accordance with the second embodiment of the present invention.
Figure 9:
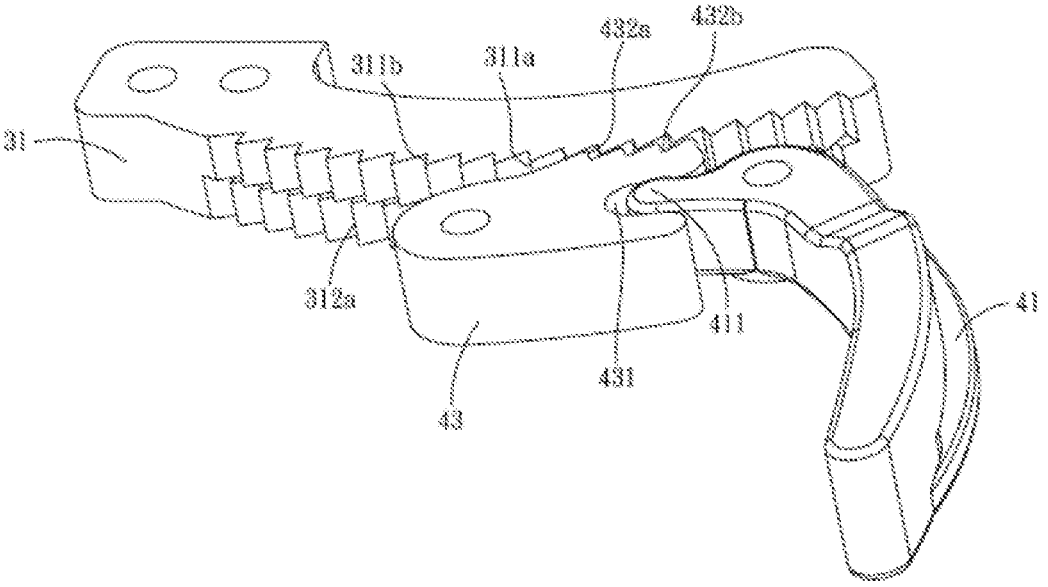
FIG. 9 is an engagement schematic view of a ratchet toothed assembly and a control assembly in accordance with the second embodiment of the present invention.

As shown in FIGS. 8 and 9, which are an exploded view and an engagement schematic view of the ratchet toothed assembly and the control assembly according to the second embodiment of the present invention, the specific implementations of which are generally the same as those of the first embodiment described above, only the differences will be explained below, and the same points will not be described again.

In this embodiment, the ratchet toothed assembly 30 has a first rack 31, and the first rack 31 is also arcuate strip-shaped, and the arc center point of the first rack 31 coincides with the circle center of the connecting shaft 13, and the guide groove 21 of the swing assembly 20 also matches the shape of the arcuate strip-shaped first rack 31, so that the guide groove 21 is also arcuate strip-shaped. In this way, the first rack 31 can slide therein along the guide groove 21.

The outer arc surface of the first rack 31 has a plurality of first ratchet teeth 311 and a plurality of second ratchet teeth 312 which are in parallel with each other, and each of the first ratchet teeth 311 and each of the second ratchet teeth 312 are misaligned with each other. Specifically, the plurality of first ratchet teeth 311 each have a first ratchet tooth tip end 311*a* and a first ratchet tooth groove end 311*a*, and the plurality of second ratchet teeth 312 also each have a second ratchet tip end 312*a* and a second ratchet tooth groove end 312*b*, and the first ratchet tooth tip ends 311*a* are juxtaposed with the second ratchet tooth groove ends 312*b* and the first ratchet tooth groove ends 311*a* are juxtaposed with the second ratchet tip ends 312*a*, with the staggered structure design, the juxtaposed two ratchet teeth 311, 312 can be misaligned with each other.

The control assembly 40 comprises the trigger portion 420 and the latch portion 410, wherein the trigger portion 420 comprises [[has]] a first wrench member 41 and the latch portion 410 comprises a first latch member 43. The first wrench member 41 is located in the receiving groove 22 of the swing assembly 20, and the first wrench member 41 is pivotally connected to the swing assembly 20 via the fourth shaft 18, the first wrench member 41 is driven to be wrenchingly displaced with the fourth shaft 18 as the center of rotation. In addition, a first protrusion 411 is provided at the front end of the first wrench member 41.

The first latch member 43 is located in the receiving groove 22 of the swing assembly 20, and the first latch member 43 is pivotally connected to the swing assembly 20 via the fifth shaft 19, and the first latch member 43 is respectively driven to rotate with the fifth shaft 19 as the center of rotation. The first latch member 43 has a first indentation 431, a plurality of first pawls 432 and a plurality of second pawls 433, and the first indentation 431 is used for a first protrusion 411 of the first wrench member 41 to be embedded therein. Each of the first pawls 432 can be correspondingly engaged into each of the first ratchet teeth 311 on the first rack 31, respectively, and each of the second pawls 433 is engaged into each of the second ratchet teeth 321 on the second rack 32.

It is to be noted that each of the first pawls 432 and each of the second pawls 433 of the first latch member 43 are misaligned with each other. Specifically, the plurality of first pawls 432 each have a first pawl tip end 432*a* and a first pawl groove end 432*b*, and the plurality of second pawls 433 also each have a second pawl tip end 433*a* and a second pawl groove end 433*b*, and the first pawl tip ends 432*a* are juxtaposed with the second pawl groove ends 433*b*, and the first pawl groove ends 432*b* are juxtaposed with the second pawl tip ends 433*a*, with the staggered structure design, the two rows of the plurality of pawls 432, 433 of the first latch members 43 can be misaligned with each other.

When a user operates the first clamping arm 11 and the second clamping arm 12 to move towards each other and clamp the clamped article, the torsion spring 131 is subjected to press by the two clamping arms 11, 12 to be elastically deformed, the first pawls 432 of the first latch member 43 can be gradually skipped and be tightly engaged onto the corresponding first ratchet teeth 311 of the first rack 31, similarly, the second pawls 433 of the first latch member 43 are also gradually skipped and are tightly engaged onto the corresponding second ratchet teeth 321 of the second rack 32. Meanwhile, by means of elastic reset force of the elastic component 50, the first protrusion 411 of the first wrench member 41 is in the first indentation 431, the first latch member 43 is toggled to be normally held in the engaged position, so that the clamping force of the two clamping arms 11, 12 can be maintained.

When a user operates the first clamping arm 11 and the second clamping arm 12 to move away from each other and release the clamped article, the first wrench member 41 can be first operated to be rotationally displaced so that the first protrusion 411 of the first wrench member 41 is in the first indentation 431, the first latch member 43 is toggled from the engaged position to the released position so that each of the first pawls 432 of the first latch member 43 is moved away from the corresponding first ratchet teeth 311, and each of the second pawls 433 of the first latch member 43 is synchronously moved away from the corresponding second ratchet teeth 312. After the first latch member 43 is moved to the released position, the two clamping arms 11, 12 are returned to the open position by means of elastic reset force of the torsion spring 131, and then performs the next clamping operation.

Figure 10:
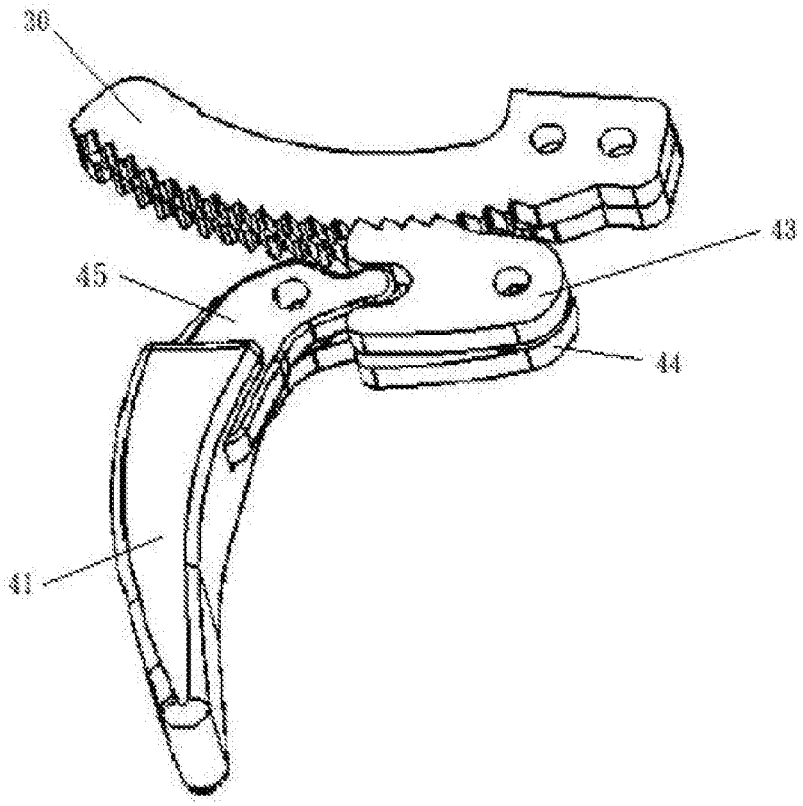
FIG. 10 is an exploded view of a ratchet toothed assembly and a control assembly in accordance with the third embodiment of the present invention.
Figure 11:
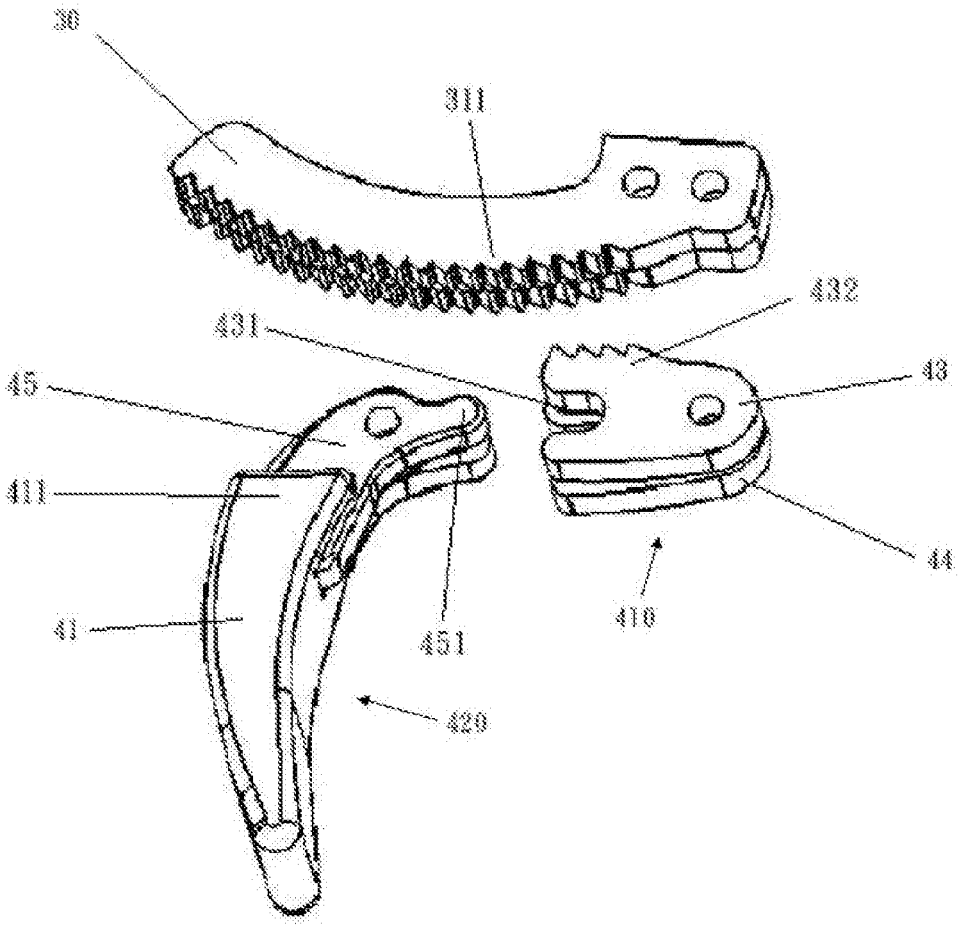
FIG. 11 is an engagement schematic view of a ratchet toothed assembly and a control assembly in accordance with the third embodiment of the present invention.

As shown in FIGS. 10 and 11, which are an exploded view and an engagement schematic view of the ratchet toothed assembly and the control assembly according to the third embodiment of the present invention, the implementations of which are generally the same as those of the first embodiment described above, only the differences will be explained below, and the same points will not be described again. In this embodiment, the control assembly 40 comprises the trigger portion 420 and the latch portion 410, and the trigger portion 420 comprises [[has]] a first wrench member 41 and a trigger member 45, and the latch portion 410 comprises a first latch member 43 and a second latch member 44, and the trigger member 45 is juxtaposed at the side of the first wrench member 41. When assembled, the first wrench member 41 and the trigger member 45 are mounted in the receiving groove 22 of the swing assembly 20, respectively, and the first wrench member 41 and the trigger member 45 are pivotally connected to the swing assembly 20 via the fourth shaft 18, respectively, and the first wrench member 41 and the trigger member 45 are respectively driven to be wrenchingly displaced with the fourth shaft 18 as the center of rotation. In addition, a first protrusion 411 is provided at the front end of the first wrench member 41, and a trigger protrusion 451 is also provided at the front end of the trigger member 45.

With the structure design of the trigger member 45, when a user wants to operate the ratchet mechanism to disengage, the user can first wrench the first wrench member 41 to be rotationally displaced so that the first protrusion 411 of the first wrench member 41 is the first indentation 431, the first latch member 43 is toggled from the engaged position to the released position so that each of the first pawls 432 of the first latch member 43 is moved away from the corresponding first ratchet teeth 311. Thereafter, in the actions similar to pulling the trigger, the trigger member 45 is pressed by the index finger so that the trigger protrusion 451 of the trigger member 45 is in the second indentation 441, the second latch member 44 is toggled from the engaged position to the released position so that each of the second pawls 442 of the second latch member 44 is moved away from the corresponding second ratchet teeth 321, thereby gradually releasing the clamping force of the clamping mechanism 10.

Figure 12:
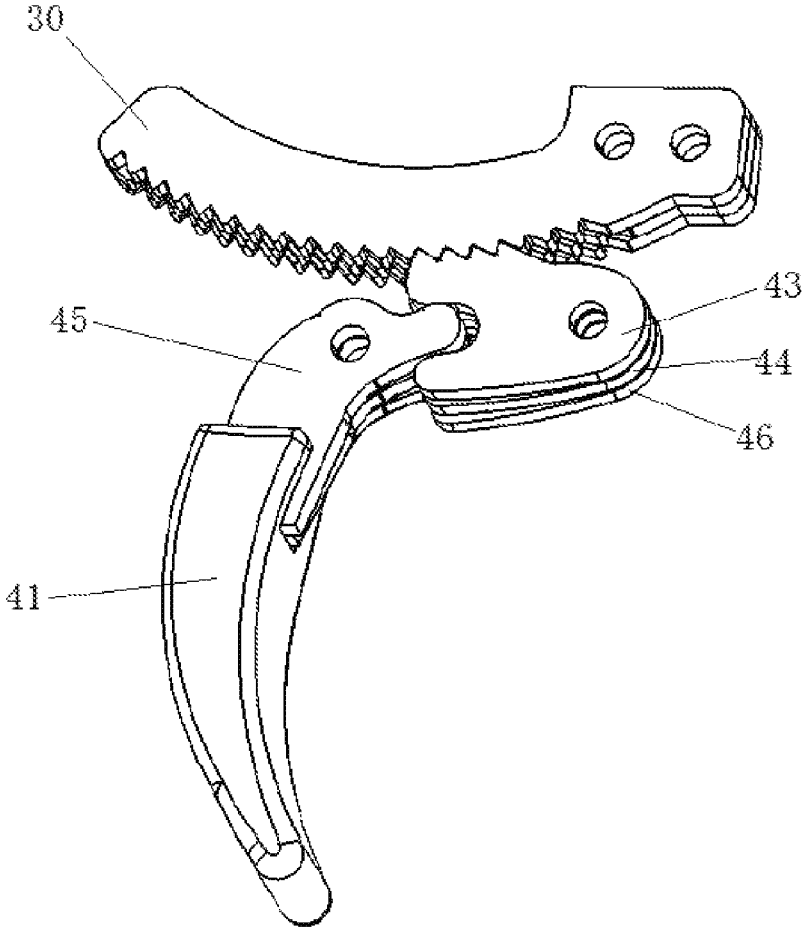
FIG. 12 is an exploded view of a ratchet toothed assembly and a control assembly in accordance with the fourth embodiment of the present invention.
Figure 13:
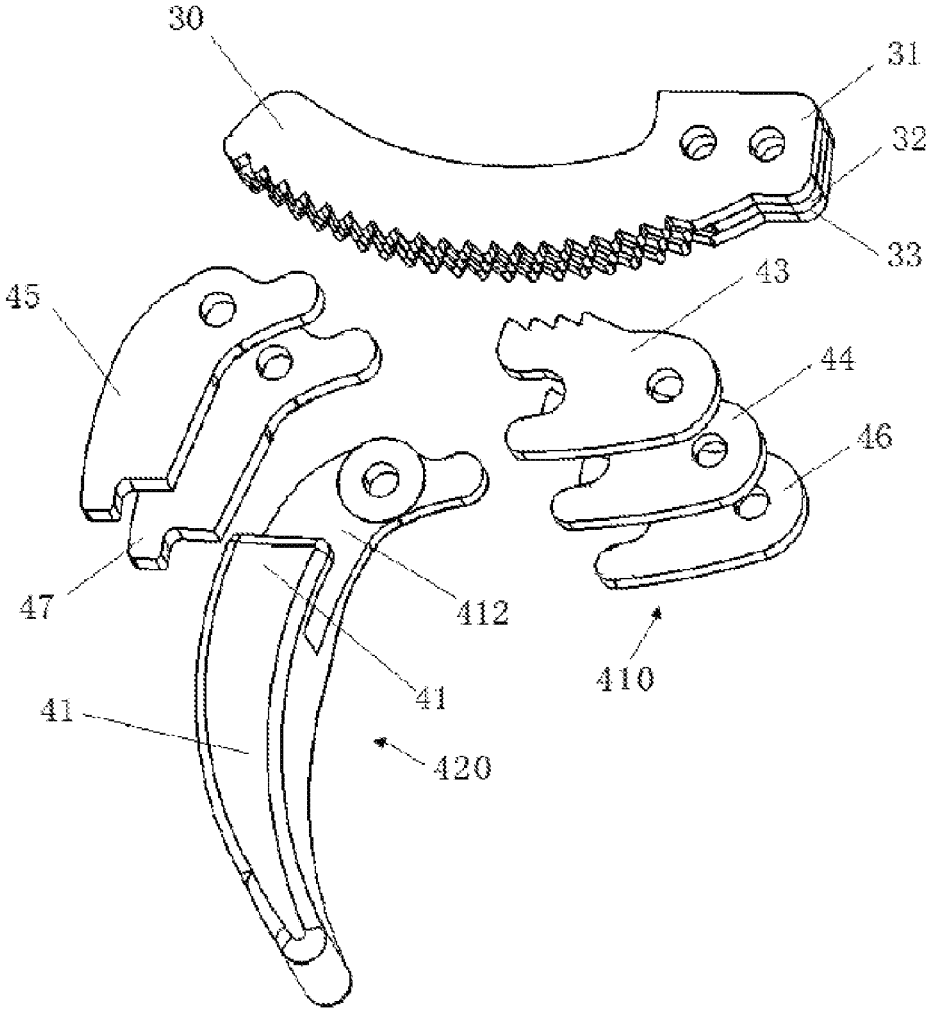
FIG. 13 is an engagement schematic view of a ratchet toothed assembly and a control assembly in accordance with the fourth embodiment of the present invention.

As shown in FIGS. 12 and 13, which are an exploded view and an engagement schematic view of the ratchet toothed assembly and the control assembly according to the fourth embodiment of the present invention, the specific implementations of which are generally the same as those of the third embodiment described above; only the differences will be explained below, and the same points will not be described again. In this embodiment, the control assembly 40 comprises the trigger portion 420 and the latch portion 410, and the trigger portion comprises [[has]] a first wrench member 41 and a trigger member 45 and a second trigger member 47, and the latch portion 410 comprises a first latch member 43, a second latch member 44 and a third latch member 46, and the trigger member 45 and the second trigger member 47 are juxtaposed at the side of the first wrench member 41. When assembled, the first wrench member 41 and the trigger member 45 and the second trigger member 47 are mounted in the receiving groove 22 of the swing assembly 20, respectively, and the first wrench member 41 and the trigger member 45 and the second trigger member 47 are pivotally connected to the swing assembly 20 via the fourth shaft 18, respectively, and the first wrench member 41 and the trigger member 45 and second trigger member 47 are respectively driven to be wrenchingly displaced with the fourth shaft 18 as the center of rotation. In addition, a first protrusion 411 and a first wrench member trigger end 412 having the same shape as the trigger member 45 and the second trigger member 47 are provided at the front end of the first wrench member 41, and a trigger protrusion 451 is also provided at the front end of the trigger member 45.

With the structure design of the trigger member 45, when a user wants to operate the ratchet mechanism to disengage, the user can first wrench the first wrench member to be rotationally displaced so that the first protrusion 411 of the first wrench member 41 is in the indentation 431, the first latch member 43 is toggled from the engaged position to the released position so that each of the first pawls 432 of the first latch member 43 is moved away from the corresponding first ratchet teeth 311. Thereafter, in the actions similar to pulling the trigger, the trigger member 45 is pressed by the index finger so that the trigger protrusion 451 of the trigger member 45 is in the second indentation 441, the second latch member 44 is toggled from the engaged position to the released position so that each of the second pawls 442 of the second latch member 44 is moved away from the corresponding second ratchet teeth 321, thereby gradually releasing the clamping force of the clamping mechanism 10.

In view of the above, the ratchet clamps disclosed in accordance with all of the embodiments of the present invention described above, with the design of two rows of ratchet teeth which are juxtaposed and are misaligned with each other, allows the double rows of misaligned ratchet teeth to maintain the original structural strength without reducing the tooth profile, and increases the number of the ratchet teeth with the design of double rows of misaligned ratchet teeth, thereby reducing the tooth spaces when engaged, to increase the overall engagement area, for dispersing the force applied on the ratchet tooth. It is ensured that the ratchet tooth and the pawls are able to skip normally when they reach the default value of the clamping force so as to control the degree of clamping force applied by the accurate clamp mechanism to avoid the problems such as failing to skip smoothly, deviating easily, or breaking tooth due to abrasion when the clamping force reaches the default value.

The specific embodiments of the invention have been described in detail in the above implementations. It is to be understood that numerous modifications and variations can be made by those skilled in the art to which the present invention pertains in accordance with the technical concepts of the present invention once the above-mentioned technical concepts, specific embodiments and effects of the present invention are appreciated. Hence, the technical solutions that can be derived by those skilled in the art according to the technical concepts of the present invention on the basis of the prior art through logical analysis, reasoning and limited experiments should be within the scope of protection defined by the claims.

LISTING OF REFERENCE NUMERALS

10 clamping mechanism
11 first clamping arm
12 second clamping arm
13 connecting shaft
131 torsion spring
14 jaw
15 first shaft
16 second shaft
17 third shaft
18 fourth shaft
19 fifth shaft
20 swing assembly
21 guide groove
22 receiving groove
23 opening
30 ratchet toothed assembly
31 first rack
311 first ratchet tooth
311*a* first ratchet tooth tip end
311*b* first ratchet tooth groove end
312 second ratchet tooth
312*a* second ratchet tooth tip end
312*b* second ratchet tooth groove end
32 second rack
321 second ratchet tooth
321*a* second ratchet tooth tip end
321*b* second ratchet tooth groove end
33 third rack
331 third ratchet tooth
40 control assembly
41 first wrench member
410 latch portion
411 first protrusion
412 trigger end of the first wrench member
42 second wrench member
420 trigger portion
421 second protrusion
43 first latch member
431 first indentation
432 first pawl
432*a* first pawl tip end
432*b* first pawl groove end
433 second pawl
433*a* second pawl tip end
433*b* second pawl groove end
44 second latch member
441 second indentation
442 second pawl
442*a* second pawl tip end
442*b* second pawl groove end
45 trigger member
451 trigger protrusion
46 third latch member
47 second trigger member
50 elastic component

The invention claimed is:

1. A ratchet clamp comprising a first clamping arm, a second clamping arm and a ratchet mechanism, the first clamping arm and the second clamping arm are pivotally connected to each other via a connecting shaft so as to be opened and closed relative to each other, the ratchet mechanism is provided between the first clamping arm and the second clamping arm, wherein:

the ratchet mechanism comprises:

a ratchet toothed assembly provided on the first clamping arm, the ratchet toothed assembly comprising a plurality of racks, each of the plurality of racks having a plurality of ratchet teeth, the ratchet teeth on different ones of the plurality of racks are juxtaposed and misaligned with each other;

a swing assembly provided on the second clamping arm, the first clamping arm and the second clamping arm respectively drive the swing assembly and the ratchet toothed assembly to move away from or towards each other with the connecting shaft as an axial center of rotation; and a control assembly having a latch portion and a trigger portion, the latch portion having a plurality of pawls, each of the plurality of pawls having at least one ratchet-tooth, wherein the ratchet tooth on different ones of the plurality of pawls are juxtaposed and misaligned with each other; and the trigger portion is used for toggling the control member, so that the pawls of the latch portion and the racks of the ratchet toothed assembly are moved between an engaged position and a released position;

one or more of the ratchet teeth on only one of the plurality of racks are engaged with a corresponding one or more ratchet teeth of the pawls and other of plurality of racks are not engaged with corresponding ratchet teeth of the pawls when the latch portion is moved to the engaged position, and all of the racks and the pawls are simultaneously released when the latch portion is moved to the released position; and an elastic component provided between the trigger portion and the second clamping arm so that the ratchet teeth on at least one of the plurality of racks and a corresponding one or more ratchet teeth of the pawls are held in engagement.

2. The ratchet clamp according to claim 1, wherein the latch portion comprising a plurality of latch members, each of the pawls being provided on each of the latch members respectively, and the trigger portion comprising a plurality of wrench members, wherein each of the wrench members has a protrusion and each of the latch members has an indentation, wherein the protrusion is used for being embedded into the indentation, and the protrusion toggles the latch member within the indentation to be rotationally displaced when the wrench member is rotationally displaced.

3. The ratchet clamp according to claim 1, wherein the connecting shaft is sleeved with a torsion spring, the two ends of the torsion spring abut against the first clamping arm and the second clamping arm, respectively, the first clamping arm and the second clamping arm are normally held in an open position by means of elastic force of the torsion spring, the swing assembly is pivotally connected to the second clamping arm via a first shaft through which the swing assembly is braked to be moved along with the second clamping arm, the ratchet toothed assembly is pivotally connected to the first clamping arm via a second shaft and a third shaft through which the ratchet toothed assembly is braked to be moved along with the first clamping arm.

4. The ratchet clamp according to claim 2, wherein the swing assembly comprises:

a guide groove formed on one side of the swing assembly for the ratchet toothed assembly to slide therein, the ratchet toothed assembly is arcuate strip-shaped, the shape of the guide groove matches the shape of the ratchet toothed assembly, so that the ratchet toothed assembly slides in the guide groove in an arcuate path;

a receiving groove formed on the other side of the swing assembly for the control assembly to be pivotally provided therein; and an opening provided between the guide groove and the receiving groove for the guide groove and the receiving groove to communicate with each other, the plurality of ratchet teeth extend through the opening into the receiving groove when the ratchet toothed assembly is placed into the guide groove, so that the plurality of ratchet teeth correspond to the pawls.

5. The ratchet clamp according to claim 4, wherein the plurality of pawls comprises a first pawl and a second pawl, and the plurality of racks comprises a first rack and a second rack correspond to the first pawl and the second pawl respectively, and only one pair of the racks and pawls is engaged and the other pair is not engaged when the latch member is moved to the engaged position, and the two pairs of racks and pawls are simultaneously released when the latch member is moved to the released position.

6. The ratchet clamp according to claim 5, wherein a plurality of first ratchet teeth are provided on the first rack, and a plurality of second ratchet teeth are provided on the second rack, wherein the plurality of first ratchet teeth of the first rack and the plurality of second ratchet teeth of the second rack extend through the opening into the receiving groove when the ratchet toothed assembly is placed into the guide groove, so that the plurality of first ratchet teeth of the first rack correspond to the first pawl and the plurality of second ratchet teeth of the second rack correspond to the second pawl.

7. The ratchet clamp according to claim 6, wherein the second rack is in parallel with the first rack, and the first rack and the second rack are both arcuate strip-shaped, and the arc centers of the first rack and the second rack coincide with the circle center of the connecting shaft.

8. The ratchet clamp according to claim 6, wherein the plurality of first ratchet teeth each have a first ratchet tooth tip end and a first ratchet tooth groove end, and the plurality of second ratchet teeth each have a second ratchet tooth tip end and a second ratchet tooth groove end, each of the first ratchet tooth tip ends and each of the second ratchet tooth groove ends are in parallel with each other, and each of the first ratchet tooth groove ends and each of the second ratchet tooth tip ends are in parallel with each other.

9. The ratchet clamp according to claim 1, wherein the trigger portion comprises:

a first wrench member;

a second wrench member, and the first wrench member and the second wrench member are respectively pivotally connected to the swing assembly via a fourth shaft, and the first wrench member and the second wrench member are respectively driven to be rotationally displaced with the fourth shaft as a center of rotation; and the latch portion comprises:

a first latch member on which a first pawl of the plurality of pawls of the latch portion are provided; and a second latch member on which a second pawl of the plurality of pawls of the latch portion are provided; wherein the first latch member and the second latch member are respectively pivotally connected to the swing assembly via a fifth shaft, and the first latch member and the second latch member are respectively driven to be rotationally displaced with the fifth shaft as the center of rotation.

10. The ratchet clamp according to claim 9, wherein the first wrench member has a first protrusion for being embedded into a first indentation of the first latch member, and the second wrench member has a second protrusion for being embedded into a second indentation of the second latch member, wherein the first protrusion toggles the first latch member within the first indentation to be rotationally displaced and the second protrusion toggles the second latch member within the second indentation to be rotationally displaced when the first wrench member and the second wrench member are rotationally displaced.

11. The ratchet clamp according to claim 9, wherein the first latch member and the second latch member are provided in parallel with each other, so that the first pawls and the second pawls are misaligned with each other, wherein the first pawls each has a first pawl tip end and a first pawl groove end, and the second pawls each has a second pawl tip end and a second pawl groove end, and the first pawl tip end and the second pawl groove end are in parallel with each other, and the first pawl groove end and the second pawl tip end are in parallel with each other.

12. The ratchet clamp according to claim 1, wherein the ratchet toothed assembly has the plurality of racks which includes a first rack and a second rack which are both arcuate strip-shaped, and a plurality of first ratchet teeth and a plurality of second ratchet teeth are juxtaposed on the first rack and the second rack, respectively, and the first rack and the second rack are both arcuate strip-shaped, and an arc center of the first rack and an arc center of the second rack coincide with an circle center of the connecting shaft.

13. The ratchet clamp according to claim 12, wherein the plurality of first ratchet teeth each has a first ratchet tooth tip end and a first ratchet tooth groove end, and the plurality of second ratchet teeth each has a second ratchet tooth tip end and a second ratchet tooth groove end, wherein the first ratchet tooth tip end and the second ratchet tooth groove end are in parallel with each other, and the first ratchet tooth groove end and the second ratchet tooth tip end are in parallel with each other.

14. The ratchet clamp according to claim 1, wherein the trigger portion comprises:

a first wrench member which is pivotally connected to the swing assembly via a fourth shaft, and the first wrench member is driven to be rotationally displaced with the fourth shaft as a center of rotation; and the latch portion comprises:

a first latch member on which a first pawl and a second pawl, of the plurality of pawls, are provided, and the first latch member is pivotally connected to the swing assembly via a fifth shaft, and the first latch member is respectively driven to be rotationally displaced with the fifth shaft as a center of rotation;

wherein the first wrench member has a first protrusion for being embedded into a first indentation of the first latch member, and the first protrusion toggles the first latch member within the first indentation to be rotationally displaced when the first wrench member is rotationally displaced.

15. The ratchet clamp according to claim 14, wherein the first pawls and the second pawls are misaligned with each other, wherein the first pawls each has a first pawl tip end and a first pawl groove end, and the second pawls each has a second pawl tip end and a second pawl groove end, and the first pawl tip end and the second pawl groove end are in parallel with each other, and the first pawl groove end and the second pawl tip end are in parallel with each other.

16. The ratchet clamp according to claim 2, wherein the plurality of wrench members comprises a first wrench member and the trigger portion further comprises a trigger member which is juxtaposed at the side of the first wrench member and is smaller than the first wrench member, the first wrench member and the trigger member are respectively pivotally connected to the swing assembly via a fourth shaft, and the first wrench member and the trigger member are respectively driven to be rotationally displaced with the fourth shaft as the center of rotation; and the plurality of latch members comprises:

a first latch member on which a first pawl of the plurality of pawls is provided; and a second latch member on which a second pawl of the plurality of pawls is provided, the first latch member and the second latch member are respectively pivotally connected to the swing assembly via a fifth shaft, and the first latch member and the second latch member are respectively driven to be rotationally displaced with the fifth shaft as the center of rotation.

17. The ratchet clamp according to claim 16, wherein the first wrench member has a first protrusion for being embedded into a first indentation of the first latch member, the trigger has a trigger protrusion for being embedded into a second indentation of the second latch member, the first protrusion toggles the first latch member within the first indentation to be rotationally displaced and the trigger protrusion toggles the second latch member within the second indentation to be rotationally displaced when the first wrench member and the trigger member are rotationally displaced.

18. The ratchet clamp according to claim 16, wherein the first latch member further comprises a plurality of first pawls, the second latch member further comprises a plurality of second pawls, the first latch member and the second latch member are provided in parallel with each other, so that the plurality of first pawls and the plurality of second pawls are misaligned with each other, the plurality of first pawls each have a first pawl tip end and a first pawl groove end, the plurality of second pawls each have a second pawl tip end and a second pawl groove end, each of the first pawl tip ends and each of the second pawl groove ends are in parallel with each other, and each of the first pawl groove ends and each of the second pawl tip ends are in parallel with each other.

19. The ratchet clamp according to claim 1, wherein the trigger portion comprises:

a first wrench member;

a first trigger member which is juxtaposed at a side of the first wrench member and is smaller than the first wrench member, and the first wrench member and the trigger member are respectively pivotally connected to the swing assembly via a fourth shaft, and the first wrench member and the trigger member are respectively driven to be rotationally displaced with the fourth shaft as an center of rotation;

a second trigger member which is juxtaposed at a side of the first wrench member and is smaller than the first wrench member, and the first wrench member and the second trigger member are pivotally connected to the swing assembly via a fourth shaft, respectively, and the first wrench member and the second trigger member are respectively driven to be rotationally displaced with the fourth shaft as an center of rotation; and the latch portion comprises:

a first latch member on which a first pawl of the plurality of pawls on the latch portion are provided;

a second latch member on which a second pawl of the plurality of pawls on the latch portion are provided; and a third latch member on which a third pawl of the plurality of pawls on the latch portion are provided, wherein the first latch member, the second latch member and the third latch member are respectively pivotally connected to the swing assembly via a fifth shaft, and the first latch member, the second latch member and the third latch member are respectively driven to be rotationally displaced with the fifth shaft as the center of rotation.

20. The ratchet clamp according to claim 19, wherein the first trigger member has a first protrusion for being embedded into a first indentation of the first latch member, and the second trigger member has a second protrusion for being embedded into a second indentation of the second latch member, and the first wrench member has a trigger protrusion for being embedded into a third indentation of the third latch member, wherein the first protrusion toggles the first latch member within the first indentation to be rotationally displaced, and the second protrusion toggles the second latch member within the second indentation to be rotationally displaced, and the trigger protrusion toggles the third latch member within the third indentation to be rotationally displaced, when the first wrench member as well as the first trigger member and the second trigger member are rotationally displaced.

21. The ratchet clamp according to claim 19, wherein the first pawls, the second pawls and the third pawls are misaligned with each other when the first latch member, the second latch member and the third latch member are provided in parallel with each other, wherein the first pawls each has a first pawl tip end and a first pawl groove end, and the second pawls each has a second pawl tip end and a second pawl groove end, and the third pawls each has a third pawl tip end and a third pawl groove end, and the first pawl tip end and the second pawl groove end are in parallel with each other, and the first pawl groove end and each of the second pawl tip end are in parallel with each other.

* * * * *